US010918542B2

(12) United States Patent
Daniel

(10) Patent No.: US 10,918,542 B2
(45) Date of Patent: Feb. 16, 2021

(54) ATTACHMENT FOR A WHEELCHAIR

(71) Applicant: Kevin Daniel, Newquay (GB)

(72) Inventor: Kevin Daniel, Newquay (GB)

( * ) Notice: Subject to any disclaimer, the term of this patent is extended or adjusted under 35 U.S.C. 154(b) by 351 days.

(21) Appl. No.: 15/774,565

(22) PCT Filed: Nov. 11, 2016

(86) PCT No.: PCT/GB2016/053537
§ 371 (c)(1),
(2) Date: May 8, 2018

(87) PCT Pub. No.: WO2017/081475
PCT Pub. Date: May 18, 2017

(65) Prior Publication Data

US 2020/0253799 A1 Aug. 13, 2020

(30) Foreign Application Priority Data

Nov. 11, 2015 (GB) ..... 1519918.5

(51) Int. Cl.
*A61G 5/04* (2013.01)
*A61G 5/10* (2006.01)
*A61G 5/12* (2006.01)

(52) U.S. Cl.
CPC ..... *A61G 5/047* (2013.01); *A61G 5/1051* (2016.11); *A61G 5/128* (2016.11)

(58) Field of Classification Search
CPC ..... A61G 5/047
USPC ..... 180/12
See application file for complete search history.

(56) References Cited

U.S. PATENT DOCUMENTS 5,016,720 A * 5/1991 Coker ..... A61G 5/047 180/13
5,351,774 A * 10/1994 Okamoto ..... A61G 5/047 180/11
7,306,250 B1 * 12/2007 Mills ..... A61G 5/047 180/11
7,721,835 B2 * 5/2010 Radtke ..... B62M 6/40 180/205.5
9,757,290 B1 * 9/2017 Scognamiglio ..... A61G 5/10
2003/0000748 A1 * 1/2003 McHardy ..... A61G 5/1051 180/13
2004/0108147 A1 * 6/2004 Ross ..... A61G 5/047 180/13
2005/0206115 A1 * 9/2005 Lee ..... A61G 5/047 280/250.1
2006/0000664 A1 * 1/2006 Huang ..... A61G 5/047 180/198

(Continued)

FOREIGN PATENT DOCUMENTS

GR 1 006 063 B 9/2008
WO 2004021954 A1 3/2004

*Primary Examiner* — Tony H Winner
(74) *Attorney, Agent, or Firm* — Craft Chu PLLC; Andrew W. Chu

(57) ABSTRACT

An attachment for a wheelchair, having a seat frame with a foot support, includes a frame, which supports an electric motor, a battery and a steering mechanism, and a wheel that is powered by the electric motor and is steerable by the steering mechanism. The attachment also includes a hook for supporting the foot support of the wheelchair when the attachment and the wheelchair are attached to one another.

18 Claims, 2 Drawing Sheets

(56) References Cited

U.S. PATENT DOCUMENTS

| | | | | |
|---|---|---|---|---|
| 2007/0096427 | A1* | 5/2007 | Knaub | A61G 5/1051 280/304.1 |
| 2008/0115982 | A1* | 5/2008 | Lin | A61G 5/1051 180/13 |
| 2010/0012400 | A1* | 1/2010 | Patmont | A61G 5/026 180/12 |
| 2016/0317368 | A1* | 11/2016 | Bach Castillo | A61G 5/027 |

* cited by examiner

ATTACHMENT FOR A WHEELCHAIR

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

According to the present disclosure, there is provided an attachment for providing powered movement to a manual wheelchair.

2. Description of Related Art Including Information Disclosed Under 37 CFR 1.97 and 37 CFR 1.98

Powered attachments for wheelchairs, particularly fixed frame wheelchairs, are well known. To date, however, all arrangements have suffered from one or more significant drawbacks. Among these drawbacks have been: complex mechanisms for the attachment to wheelchairs and/or the need to attach portions of attachment mechanisms to wheelchairs at least semi-permanently, which adds weight/bulk to the wheelchair when in normal use; poor stability and performance of the attachments; and generally bulky/cumbersome design.

BRIEF SUMMARY OF THE INVENTION

The present invention arose in a bid to provide an improved powered attachment for a wheelchair. In particular, an attachment having low bulk and weight, improved stability and performance, and a simple attachment mechanism allowing for attachment by a wheelchair user unaided and without the need for any attachment mechanism to be attached to the wheelchair during normal use (i.e. when detached from the attachment).

According to the present invention in a first aspect there is provided an attachment for a wheelchair having a seat frame, including a foot support, the attachment comprising: a frame, which supports an electric motor, a battery and a steering mechanism, and a wheel that is powered by the electric motor and is steerable by the steering mechanism, wherein the attachment comprises a hook for supporting the foot support of the wheelchair when the attachment and the wheelchair are attached to one another.

By such an arrangement, the attachment may be easily and effectively attached to a wheelchair by a user. Attachment is initiated simply by engaging the foot support with the hook.

The attachment preferably further comprises an engagement means, which is engageable with the seat frame of the wheelchair at a point that is vertically spaced from the foot support in use. The engagement means preferably locks the attachment to the wheelchair.

Further, preferred, features are presented in the dependent claims.

According to the present invention in a further aspect, there is provided a method of attaching a wheelchair to an attachment as defined above comprising the steps of: raising the foot support of the wheelchair by tipping the wheelchair backwards, and placing the foot support on an upper surface of the hook; pivoting the attachment towards the wheelchair by application of a downward force to the hook by the foot support; and locking the attachment to the wheelchair using the engagement means.

According to the present invention in a further aspect, there is provided an attachment for a wheelchair having a seat frame, including a foot support, the attachment comprising: a frame, which supports an electric motor, a battery and a steering mechanism, and a wheel that is powered by the electric motor and is steerable by the steering mechanism, wherein the attachment further comprises an engagement means for engaging the foot support of the wheelchair when the attachment and the wheelchair are attached to one another and a further engagement means that is engageable with the seat frame of the wheelchair at a point that is vertically spaced from the foot support in use. The further engagement means preferably locking the attachment to the wheelchair.

According to the present invention in a further aspect there is provided an attachment for a wheelchair having a seat frame, including a foot support, the attachment comprising: a frame, which supports one or more electric motors, a battery and a steering mechanism, and a pair of wheels that are powered by the one or more electric motors and are steerable by the steering mechanism, wherein the wheels have a diameter of at least 30 cm.

BRIEF DESCRIPTION OF THE SEVERAL VIEWS OF THE DRAWINGS

Non-limiting embodiments will now be described, by way of example only, with reference to the accompanying drawings.

DETAILED DESCRIPTION OF THE INVENTION

Figure 1:
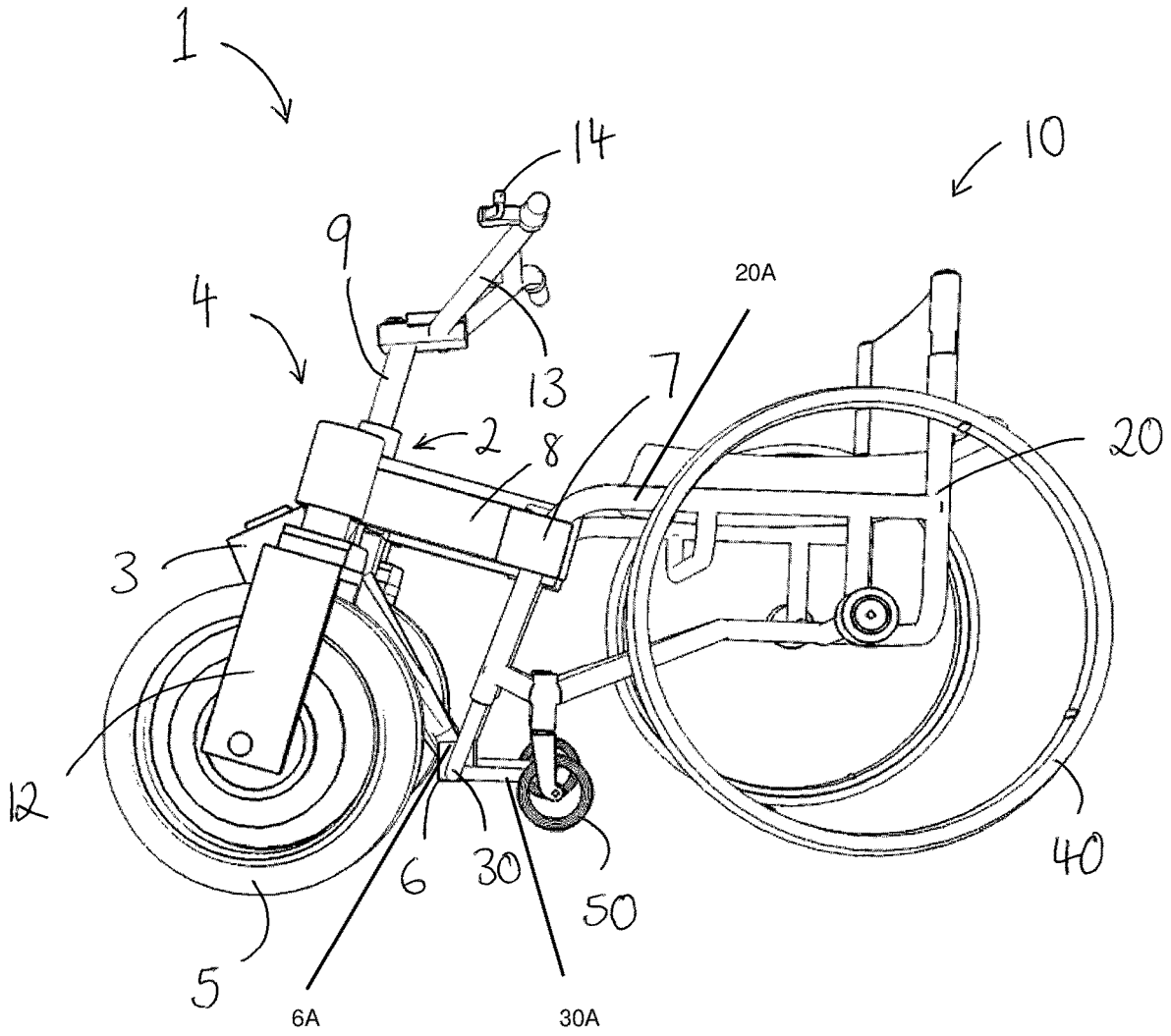
FIG. 1 shows a lower perspective view of a wheelchair attached to an attachment according to a first embodiment.
Figure 2:
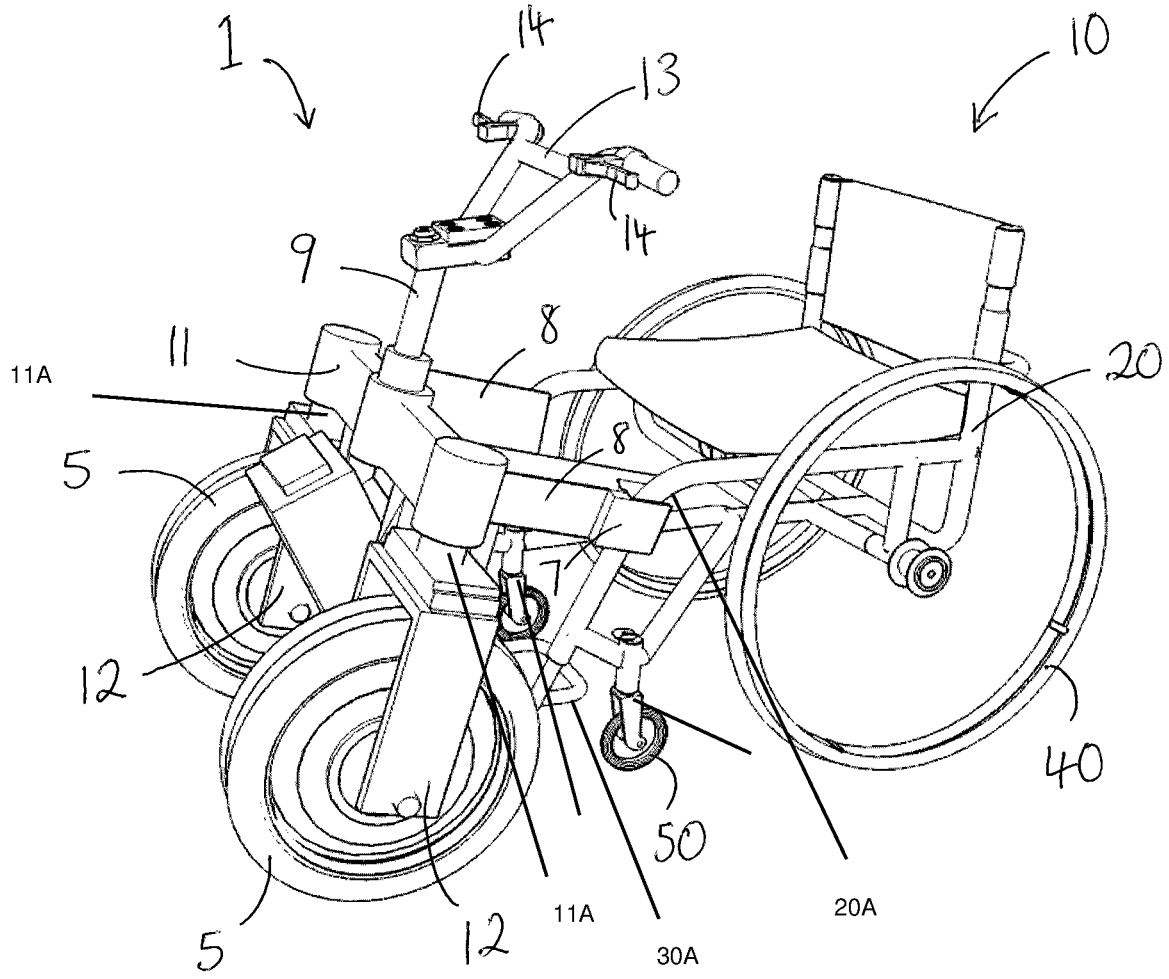
FIG. 2 shows an upper perspective view of a wheelchair attached to the attachment of FIG. 1.

With reference to the figures, there is shown an attachment 1 in accordance with a first arrangement attached to a wheelchair 10.

The wheelchair 10 comprises a conventional fixed frame wheelchair having a seat frame 20, which comprises a foot support 30 and a seat portion 20A. The foot support 30 comprises a tube (or other rigid elongate element 30A, dependent on the specific frame design of the wheelchair) that extends substantially horizontal in use. During normal use of the wheelchair, a user will rest their feet on the foot support 30. The wheelchair 10 further comprises a set of rear wheels 40 and a smaller set of front wheels 50. During normal use, by manual movement of the rear wheels 40 a user may move the wheel chair along the ground, with the wheelchair rolling on the front and rear wheels 40, 50.

In broadest terms, the attachment 1 comprises a frame 2, which supports one or more electric motors (not shown), a battery 3, a steering mechanism 4, and one or more wheels 5 that are powered by the one or more electric motors and are steerable by the steering mechanism 4.

In the present arrangement, as is preferred, the attachment is provided with two wheels 5. By the provision of two wheels 5, the attachment 1 in combination with a wheelchair 10 effectively forms an electrically powered quad bike. Of course in arrangements in which the attachment 1 is provided with a single wheel 5, as is conceived within the scope of the present disclosure, the attachment in combination with a wheelchair 10 would effectively form an electrically powered trike. In the two-wheeled arrangement, as shown, the wheels 5 are spaced from one another in an axial direction. There is a hub mounted electric motor associated with each wheel 5. The wheels 5 are preferably spaced from one another in the axial direction by substantially the same distance as the rear wheels 40 of the wheelchair. The wheels 5 have a much larger diameter than the front wheels 50 of the wheelchair, which are spaced from the ground following attachment of the wheelchair 10 to the attachment 1, as seem most clearly in FIG. 1. The wheels 5 preferably have a diameter of at least 30 cm. The wheels 5 preferably have pneumatic tyres to allow for suitable use over rougher terrain. Also, each of the wheels 5 preferably comprises a plurality of rims and tyres that are joined together, or alternatively a unified hub with multiple tyres for each wheel. In the present arrangement each wheel 5 comprises three rims and tyres. The provision of multiple tyres per wheel allows for a low cost rugged arrangement and provides for the ability to continue running even when one or more of the tyres is punctured, which provides valuable peace of mind to a disabled user who may otherwise fear being stranded. Moreover, with a hub motor provided in each wheel, there is a backup motor in the event a motor fails, again providing peace of mind.

The dual hub motors can preferably perform with a variety of voltages and may, for example, perform with voltages of 24 v, 36 v, 48 v or 60 v. The motors can perform with or without electric (i.e. regenerative) brakes. Clearly, range may be improved by use of regenerative braking with charge provided to the batteries in a conventional manner. There will typically be provided, in addition or as an alternative, a disc brake attached to each motor (double disc brake system), wherein with multiple tyres on each wheel, as is preferred, the performance is very good under braking.

The attachment most preferably comprises a hook 6 for supporting the foot support of the wheelchair when the attachment and the wheelchair are attached to one another. The hook 6 is curved or angled upwardly for supporting the foot support from underneath in use. The hook 6 and the foot support that is supported thereby extend substantially parallel to an axis of the wheels of the attachment. The hook 6 may extend for substantially the entire length of the foot support 30 or may have a small dimension relative to the axial length of the foot support 30. There may be two or more hooks arranged side by side. The hook 6 may be unitarily formed by a curved or bent plate. There may be a suitable surface coating or layer applied to the hook 6 to grip/cushion the foot support 30. The foot support 30 is preferably not provided with any latching mechanism, rather relying on the curved or angled profile of the hook to engage the foot support 30, however, latching means could be provided in some arrangements. The hook 6 engages the foot support, preferably such engagement is direct. In use, the hook support will support a vertical load of the wheelchair that has its front wheels lifted from the ground by a tilting back of the wheelchair 10.

The hook 6 forms part of an attachment mechanism, which further comprises an engagement means 7 that is engageable with the seat frame of the wheelchair at a point that is vertically spaced from the foot support in use, as clearly seen in the figures. The engagement means could act simply as a stop or abutment against which the wheelchair frame rests/abuts following engagement of the foot support on the hook and a pivoting of the wheelchair and attachment towards one another, and be formed appropriately. However, the engagement means preferably further acts to lock the attachment to the wheelchair in use. In the present arrangement the engagement means comprises a pair of clamps. The clamps are preferably arranged to directly engage the seat frame. In the present arrangement, the clamps respectively engage substantially vertically extending tubular frame members that are provided on opposed sides of the foot support 30. The arrangement of the engagement means 7 may be varied in dependence on the seat frame of the wheelchair to which the attachment is to be fixed. Moreover, whilst simple clamps are preferred for ease of attachment, which clamps may take any suitable form, the engagement means may take any of a number of different forms, as will be appreciated by those skilled in the art. It is most preferred that whatever form the engagement means takes, no portion of the engagement means is left attached to the wheelchair during its normal use. The engagement means 7 is provided to prevent the detachment of the foot rest from the hook during use and further acts to set and fix the orientation/angle of the attachment relative to the wheelchair 10.

The attachment mechanism is such that the attachment of the wheelchair 10 to the attachment 1 is a simple operation that may be completed by the user of the wheelchair unaided. The attachment may be stored/transported/maintained in a substantially vertical orientation by leaning it against a wall or other vertical item or surface, or by use of an integrated stand (not shown). The hook 6 will be arranged to face the user's wheelchair at the time of attachment. For attachment, the user will wheel the wheelchair 10 up to the attachment and raise the foot support 30 of the wheelchair 10 by tipping the wheelchair backwards. The foot support 30 may then be placed on the foot support on an upper surface 6A of the hook. By tipping the wheelchair forward following engagement, the wheelchair will apply a downward force to the hook through the foot support, with the hook ensuring engagement is maintained during this operation. The engagement means will be brought into engagement with the seat frame by the resultant pivotal movement of the attachment and may be fixed thereto (by clamping in the present arrangement) to lock the attachment to the wheelchair using the engagement means. The user may then under the power of the electric motor(s) proceed in the quad like vehicle that is thus formed. The attachment has a suitable braking arrangement, discussed below, and the brakes may be applied as appropriate to lock movement of the wheels of the attachment during the attachment operation.

The hook 6 projects rearwards of the wheels 5 of the attachment between the front wheels of the attachment, as seen in FIG. 1. The hook 6 is fixed to the frame 2. The engagement means 7, which are also fixed to the frame are preferably provided rearwards of the hook 6, as best seen in FIG. 1. Any frame configuration that allows for suitable positioning of these elements may be used. In the present arrangement, each of the clamps that define the engagement means 7 is provided on an arm 8 that projects at substantially 90 degrees to a steering column 9, discussed below. The arms are rigid. The arms could be replaced or re-configured. The arms may be foldable and lockable in a folded or extended position, which arrangement will aid with transportation and storage of the attachment 1.

The frame 2 comprises a cross member 11, which preferably extends substantially parallel in use. At each of the opposed ends of the cross member 11, there is provided a fork 12 for supporting one of the wheels 5 in a conventional manner. Again, the frame may be otherwise configured, as will be readily appreciated by those skilled in the art. The steering column 9 projects substantially vertically from the cross member in a central region thereof and terminates in a set of handlebars 13. A conventional throttle lever, switch or grip (not shown) and brake levers 14 are provided on the handlebars for suitable control of the motor speed. There will also be a switch provided for selecting forward or reverse drive of the motor(s). A suspension arrangement 11A is preferably provided for each of the forks 12 to allow for the independent vertical travel of the forks 12 and thereby the wheels 5. There is no requirement for suspension to be provided however and some arrangements will omit any suspension arrangement. The handlebars 13 are linked to the forks for turning them relative to the cross member 11 via a conventional steering mechanism, such as a rack and pinion arrangement. Any suitable steering mechanism may be implemented in dependence of the frame structure. The steering column/handle bars may be arranged such that they are unitarily removable to reduce the dimensions of the attachment for the purposes of transport or storage. With such removal, typical dimensions, which may vary depending on specific features/configurations may be 500×620×650 mm.

A battery holder, which may support one, two or more batteries 3 is provided on the frame. With a single battery, costs and weight are reduced. However, with more than one battery there is a backup power source/increased operating range and improved charging time, since the batteries may be charged simultaneously using separate chargers. The batteries and/or holder are arranged to allow for charging of the batteries in situ, i.e. without the removal of the batteries from the attachment, which improves usability by a lone individual. In accordance with the present arrangement, it is preferable that the battery holder is arranged between the wheels 5. It may be arranged at an oblique angle in use, as shown. There may be a USB or similar power connector provided to allow the charging of a mobile device, the powering of lights or otherwise. There may be a cruise control system provided for maintaining a set speed.

The attachment as described herein offers a unique arrangement that may be easily attached/detached and transported. In particular, it is small enough to fit within the boot of most cars and is light enough to be lifted by an individual. It will preferably have a weight of less than 30 kg.

Numerous alterations and modifications of the attachment 1 will be readily appreciated by those skilled within the art, within the scope of the claims that follow, and the application should be understood to encompass those modifications.

I claim:

1. An attachment for a wheelchair having a seat frame with a foot support, the attachment comprising:

a frame supporting an electric motor, a battery and a steering mechanism, and a wheel, said wheel being powered by the electric motor and is steerable by the steering mechanism, wherein the attachment comprises a hook on said frame so as to directly support the foot support of the wheelchair when the attachment and the wheelchair are attached to one another, wherein the attachment further comprises an engagement means for said frame on the seat frame, said engagement means being on said frame so as to connect a seat portion of the seat frame of the wheelchair vertically spaced from the foot support when the attachment and the wheelchair are attached to one another.

2. The attachment as claimed in claim 1, wherein the hook is curved or angled upwardly so as to support the foot support from underneath when the attachment and the wheelchair are attached to one another.

3. The attachment as claimed in claim 1, wherein said wheel has an axis, said hook extending parallel to said axis of said wheel.

4. The attachment for the wheelchair having the seat frame with the foot support, front wheels, and rear wheels as claimed in claim 1, wherein said hook and said engagement means are positioned on said frame so as to raise said front wheels of the wheelchair align said rear wheels of the wheelchair and said wheel of said frame.

5. The attachment as claimed in claim 4, wherein said frame further comprises an additional wheel so as form a pair of wheels, and wherein each wheel of said pair of wheels is spaced from one another by a set distance so as to align with said rear wheels when the attachment and the wheelchair are attached to one another.

6. The attachment as claimed in claim 1, wherein the engagement means is on said frame so as to lock the attachment to the wheelchair.

7. The attachment as claimed in claim 1, wherein the engagement means comprises a clamp.

8. The attachment as claimed in claim 1, wherein said steering mechanism comprises a set of handlebars.

9. The attachment as claimed in claim 1, wherein said frame further comprises an additional wheel so as to form a pair of wheels.

10. The attachment as claimed in claim 9, wherein the hook projects rearwards from said pair of wheels and between said pair of wheels.

11. The attachment as claimed in claim 9, wherein the battery is mounted between said pair of wheels.

12. The attachment as claimed in claim 9, wherein each wheel of said pair of wheels is comprised of a hub motor.

13. The attachment as claimed in claim 9, wherein each wheel of said pair of wheels is comprised of a plurality of rims and tires, each wheel of said pair of wheels having a respective wheel axis, each wheel axis being aligned with each other when the attachment and the wheelchair are attached to one another.

14. A system, comprising:

a wheelchair being comprised of a plurality of front wheels, a plurality of rear wheels, and a seat frame with a foot support and a seat portion; and an attachment comprising:

a frame;

an electric motor supported on said frame;

a battery connected to said electric motor and supported on said frame;

a steering mechanism supported on said frame;

a wheel being connected to said electric motor and said steering mechanism and having a wheel axis; and a hook being connected on said frame and removably attached to said foot support, wherein said front wheels and said foot support have an elevated position with said hook above said wheel and said rear wheels, and wherein a portion of the foot support extends parallel to said wheel axis.

15. The system, as claimed in claim 14, wherein said foot support is comprised of a rigid elongate element in a horizontal orientation.

16. A method of attaching, comprising the steps of:

tipping a wheelchair of a system, according to claim 14, backwards so as to raise said foot support placing said foot support on an upper surface of said hook; and applying a downward force to said hook by said foot support so as to pivot said attachment toward said wheelchair and to connect said attachment to said wheelchair.

17. The method as claimed in claim 16, wherein said attachment further comprises an engagement means for said frame on said seat frame, said engagement means being on said frame and being removably attached to said seat portion vertically spaced from the foot support, the method further comprising a step of: locking said attachment to said wheelchair with said engagement means.

18. An attachment for a wheelchair having a seat frame with a foot support, the attachment comprising:

a frame supporting an electric motor, a battery and a steering mechanism, and a wheel, said wheel being powered by the electric motor and is steerable by the steering mechanism, wherein the attachment comprises a hook on said frame so as to support the foot support of the wheelchair when the attachment and the wheelchair are attached to one another, wherein said frame further comprises:

an additional wheel so as to form a pair of wheels, an independent suspension connected to said wheel, and an additional independent suspension connected to said additional wheel so as to allow for independent vertical travel of each wheel when the attachment and the wheelchair are attached to one another.

* * * * *